US006416335B1

(12) United States Patent
Horchler

(10) Patent No.: US 6,416,335 B1
(45) Date of Patent: Jul. 9, 2002

(54) STACKED SURFACE MOUNT ELECTRICAL CONNECTOR AND CLAMPING TOOL

(75) Inventor: David C. Horchler, Millersbury, PA (US)

(73) Assignee: Berg Technology Inc., Reno, NV (US)

( * ) Notice: Subject to any disclaimer, the term of this patent is extended or adjusted under 35 U.S.C. 154(b) by 0 days.

(21) Appl. No.: 09/810,016

(22) Filed: Mar. 16, 2001

(51) Int. Cl.[7] ..... H01R 12/00
(52) U.S. Cl. ..... 439/79
(58) Field of Search ..... 439/79, 80

(56) References Cited

U.S. PATENT DOCUMENTS

| | | | | | |
|---|---|---|---|---|---|
| 4,480,884 | A | | 11/1984 | Babuka et al. | 439/59 |
| 4,861,272 | A | * | 8/1989 | Clark | 439/79 |
| 4,871,321 | A | * | 10/1989 | Johnson | 439/79 |
| 4,934,961 | A | | 6/1990 | Piorunneck et al. | 439/637 |
| 5,024,627 | A | | 6/1991 | Bennett et al. | 439/631 |
| 5,092,781 | A | | 3/1992 | Casciotti et al. | 439/62 |
| 5,106,313 | A | | 4/1992 | Lwee et al. | 439/135 |
| 5,162,002 | A | | 11/1992 | Regnier | 439/637 |
| 5,215,471 | A | | 6/1993 | Reymond et al. | 439/66 |
| 5,242,311 | A | | 9/1993 | Seong | 439/135 |
| 5,249,977 | A | | 10/1993 | Tanaka et al. | 439/135 |
| 5,397,241 | A | * | 3/1995 | Cox et al. | 439/79 |
| 5,600,102 | A | | 2/1997 | Socha | 174/261 |
| 5,816,831 | A | * | 10/1998 | Clark | 439/79 |
| 5,899,760 | A | | 5/1999 | Ho et al. | 439/135 |
| 5,920,463 | A | | 7/1999 | Thomas et al. | 361/760 |
| 6,079,999 | A | | 6/2000 | Terry et al. | 439/326 |
| 6,190,183 | B1 | * | 2/2001 | Yang et al. | 439/79 |

OTHER PUBLICATIONS

FCI Product datasheet, VHDCI receptacle assembly 84696–003, Sep. 1998.

FCI Product datasheet, VHDCI receptacle assembly 72405–001, Oct. 1996.

FCI Product datasheet, VHDCI receptacle assembly 74337–001, Oct. 1996.

* cited by examiner

*Primary Examiner*—Tulsidas Patel
(74) *Attorney, Agent, or Firm*—Perman & Green, LLP

(57) ABSTRACT

An electrical connector comprising a housing and at least one electrical contact. The housing has a first side with a first section and a second section. The first section is adapted to contact a first side of an electronic component and be fixed thereto. The second section comprises a positioning locator standoff adapted to be located in front of a second side of the electronic component for contacting a mechanically cooperating, but electrically non-mating electrical connector at the first side of the housing when the housing is located against the first side of the electronic component. The at least one electrical contact is connected to the housing and has a first end adapted to be attached to the electronic component.

19 Claims, 4 Drawing Sheets

STACKED SURFACE MOUNT ELECTRICAL CONNECTOR AND CLAMPING TOOL

BACKGROUND OF THE INVENTION

1. Field of the Invention

The present invention relates to electrical connectors and, more particularly, to a surface mounted electrical connector and a method of mounting the electrical connector.

2. Brief Description of Prior Developments

Electrical receptacle connectors which are connected to printed circuit boards, proximate an edge of the printed circuit board, and which are used as a very high density cable interconnect (VHDCI) to connect an electrical cable to the printed circuit board, are known in the art. Examples of such connectors are sold by FCI USA, Inc. of Etters, Pa. under model numbers 74337-001, 72405-001 and 84696-003. There is a desire to provide VHDCI electrical connectors as surface mount electrical connectors. A desire also exists to connect two VHDCI electrical connectors to a single printed circuit board at a same location, but on opposite sides of the printed circuit board. However, because of very small connector contact pitch, problems in precise positioning and holding of the electrical connector to the board would be encountered when attempting to surface mount connect a VHDCI electrical connector to a printed circuit board. A need exits for a system which can locate and hold a VHDCI electrical connector to a printed circuit board until the connectors are permanently attached to the board.

SUMMARY OF THE INVENTION

In accordance with one embodiment of the present invention, an electrical connector is provided comprising a housing and at least one electrical contact. The housing has a first side with a first section and a second section. The first section is adapted to contact a first side of an electronic component and be fixed thereto. The second section comprises a positioning locator standoff adapted to be located in front of a second side of the electronic component for contacting a cooperating electrically non-mating electrical connector at the first side of the housing when the housing is located against the first side of the electronic component. The electrical contact is connected to the housing and has a first end adapted to be attached to the electronic component.

In accordance with another embodiment of the present invention, an electrical connector is provided comprising at least one electrical contact; a housing member having the at least one electrical contact connected thereto; and at least one hold down connected to the housing member. The hold down comprises a first section and a second section angled relative to the first section. The first section is stationarily fixed to the housing member. The second section comprises a substantially planar flat bottom surface adapted to be soldered to a mounting surface of an electronic component and a front positioning projection extending past the planar flat bottom surface adapted to contact a positioning surface at an end edge of the electronic component which is angled relative to the mounting surface.

In accordance with another embodiment of the present invention, an electrical component assembly is provided comprising an electronic component; a first electrical connector fixedly connected on a first side of the electronic component; and a second electrical connector fixedly connected on an opposite second side of the electronic component. Portions of first and second housings of the respective first and second electrical connectors extend past an end edge of the electronic component and contact each other.

In accordance with another embodiment of the present invention, an electrical connector positioning device is provided comprising electrical connector holders pivotably connector to each other at a pivot location and a control for moving the holders about the pivot location. Each holder is adapted to individually hold a separate electrical connector. Each connector comprises a housing and at least one electrical contact. The holders can pivotably move to move electrical connectors, connected to the holders, against another member located between the electrical connectors.

In accordance with one method of the present invention, a method of connecting electrical connectors to an electronic component is provided comprising steps of connecting two electrical connectors to a positioning device, each electrical connector comprising a housing and electrical contacts; and moving the positioning device to move the two electrical connectors in opposite directions towards each other to at least partially sandwich the electronic component between the two electrical connectors at an edge of the electronic component.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
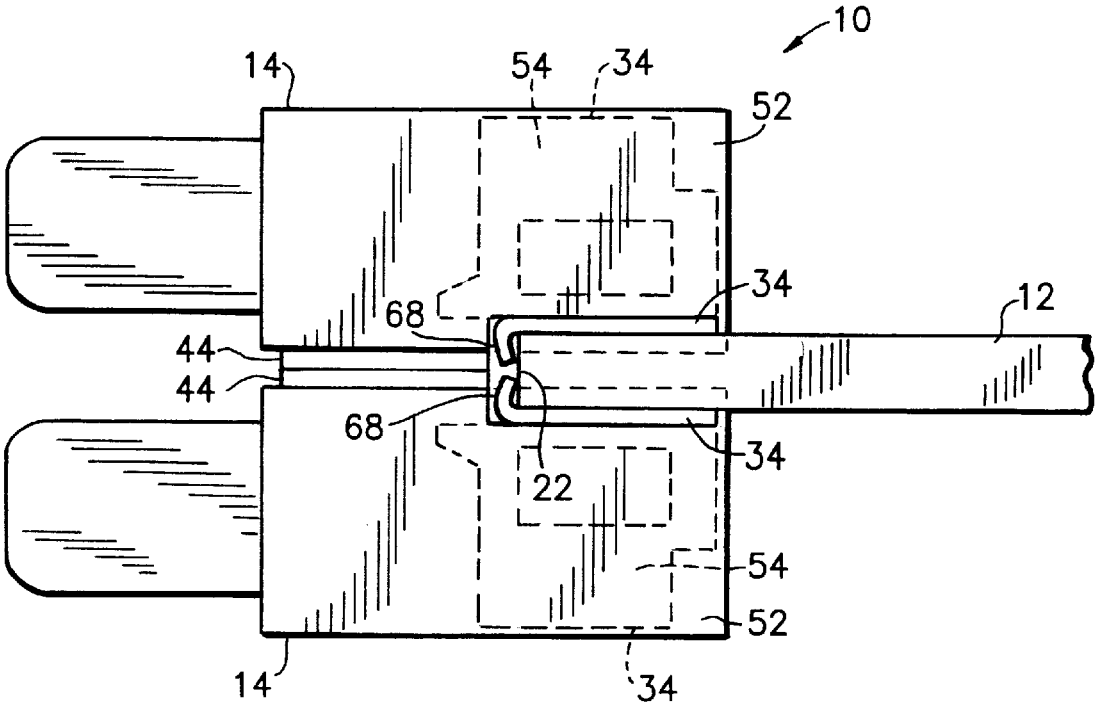
FIG. 1 is a side elevational view of an assembly incorporating features of the present invention.

Referring to FIG. 1, there is shown an elevational side view of an electrical component assembly 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figure 4:
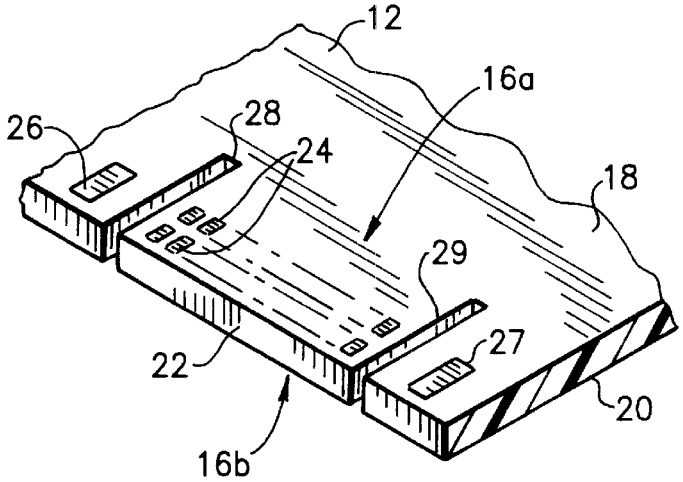
FIG. 4 is a partial cut-away perspective view of the printed circuit board shown in FIG. 1.

The assembly 10, in this embodiment, generally comprises an electrical or electronic component 12 and two electrical connectors 14. The component 12 is preferably a printed circuit board. However, in alternate embodiments the assembly could comprised any suitable electrical or electronic component. Referring also to FIG. 4, the printed circuit board 12 has two connector mounting areas 16*a*, 16*b* located on opposite sides 18, 20 of the printed circuit board 12 adjacent an end edge 22. The mounting areas 16*a*, 16*b* are substantially the same, but could be different in alternate embodiments. Each mounting area generally comprises surface mount contact pads 24, hold down surface mounting surfaces 26,27, and connector housing locator slots 28, 29. The connectors 14 can be soldered to contact pads 24 to electrically connect the connectors to the printed circuit board.

Figure 2:
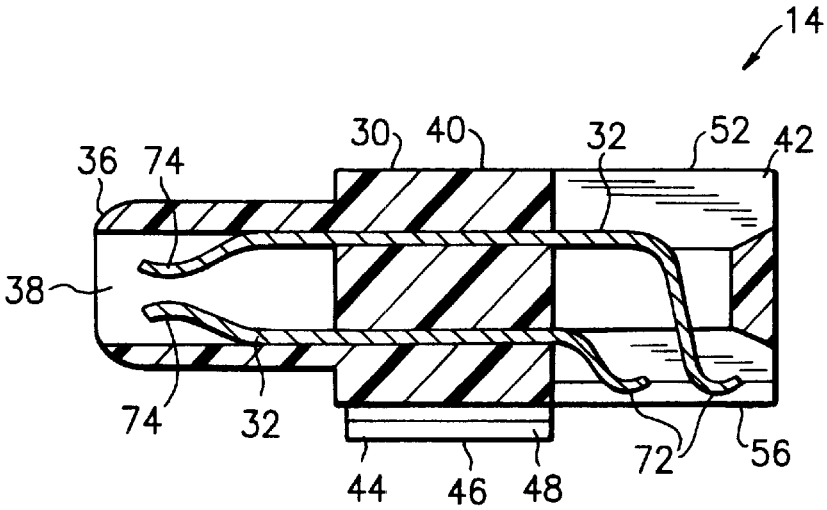
FIG. 2 is a cross-sectional view of one of the electrical connectors shown in FIG. 1.
Figure 3:
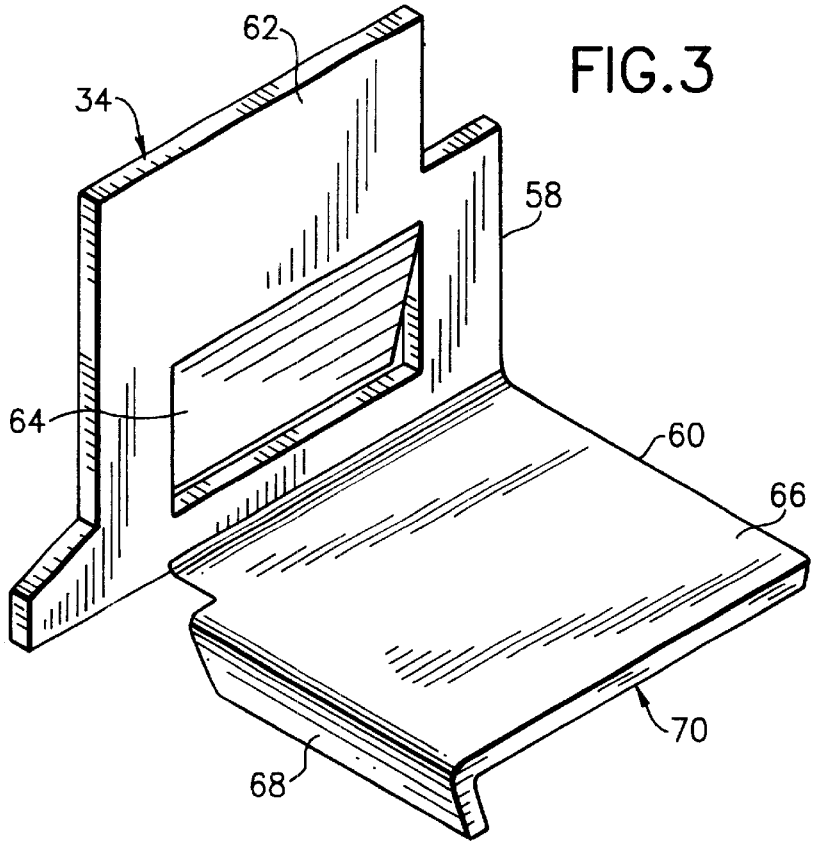
FIG. 3 is a perspective view of one of the hold downs used in the connectors shown in FIG. 1.

Referring also to FIG. 2, the connectors 14 each generally comprise a housing 30, electrical contacts 32 and hold downs 34 (see FIGS. 1 and 3). The housing 30 is preferably comprised of a molded plastic or polymer material. The housing 30 comprises a front section 36 forming a receiving area 38, a middle section 40, and a rear section 42. In alternate embodiments the housing could have any suitable shape or section shape(s). The housing 30 could also be comprised of a single member or multiple members, and any suitable material(s) could be used. The front section 36 and receiving area 38 are sized and shaped to make a removable mating connection with the housing of another electrical connector (not shown) such as part of a cable assembly. The middle section 40 fixedly secures the contacts 32 to the housing 30. The middle section 40 comprises a bottom section 44. The bottom section 44 generally comprises at least one projection 46 and recess 48. The projection(s) and recess(es) could have any suitable shapes. The projection(s) 46 form positioning locator standoff(s) for contacting the opposite cooperating electrically non-mating electrical connect of 14 in its recess(es) The interlocking nature of the projections and recesses can, align the housings 30 with each other as well as supportably locate the housings on each other. However, in alternate embodiments the recess(es) need not be provided. The lateral end walls 52 each comprise a pocket 54 and a portion 56. The pocket 54 is sized and shaped to have a portion of the hold down 34 (see FIG. 3) fixedly mounted therein. An entrance into the pocket 54 extends into the housing from the bottom side of the end walls 52. The portions 56 of the housing 30 extends from the bottom side of end walls 52. The portions 56 are sized and shaped to fit inside the locator slots 28, 29 of the printed circuit board 12. Thus, the portions 56 and slots 28, 29 can position the housing 30 relative to the board 12 for positioning the solder tails of the contacts 32 on the contact pads 24, and for positioning the hold downs 34 on the pads 26, 27.

Referring also to FIG. 3, one of the hold downs 34 is shown. Each connector 14 has two of the hold downs; one at each end wall 52. However, in alternate embodiments each connector could have more or less hold downs. In addition, the hold downs could have any suitable shape. The two hold downs for each connector in the embodiment shown are substantially mirror images of each other.

Each hold down comprises a housing mounting section 58 and a printed circuit board mounting section 60. In a preferred embodiment each hold down is comprised of a one piece member, such as a stamped and formed sheet metal member. The housing mounting section 58 has a substantially planar section 62 and a retention projection 64. The housing mounting section 58 is sized and shaped to be inserted into one of the pockets 54 and fixedly attach to the housing in the pocket. The board mounting section 60 extends from the housing mounting section 58 at an angle of about 90°. The board mounting section 60 comprises a main planar section 66 and a front positioning projection 68. The main planar section 66 comprises a substantially planar flat bottom surface 70. The front positioning projection 68 projects downward, past the bottom surface 70, and slightly rearward. When mounted to the end walls 52, the board mounting sections 60 extend laterally outward from the end walls 52.

When the connectors 14 are located at the mounting sections 16*a*, 16*b* the board mounting sections 60 are located on the mounting surfaces 26, 27. The front positioning projections 68 can be located against the end edge 22 of the printed circuit board 12. This can be used to relatively precisely locate or position the connectors relative to the end edge 22. However, in alternate embodiments the front positioning projection 68 might not be provided, or any suitable additional or alternative means could be used to precisely position the connectors 14 relative to the end edge 22. When the hold downs 34 are placed against the hold down mounting surfaces 26, 27, the hold downs can be permanently attached to the printed circuit board, such as by reflow soldering the surfaces 70 to the surfaces 26, 27.

Referring particularly to FIG. 2, the electrical contacts 32 each comprise rear solder tails 72 and front spring contact sections 74. When the connectors 14 are located at the mounting areas 16*a*, 16*b*, the solder tails 72 are spring biased against respective ones of the contact pads 24. Reflow soldering can then permanently surface mount the solder tails on the pads 24. The spring contact sections 74 are located in the receiving area 38. The spring contact sections 74 can deflect outward when a portion of a mating connector (not shown) is inserted between the rows of spring contact sections 74 for a removable connection between the mating connectors. The spring contact sections 74 are shaped or contoured to provide contact wipe and provide good contact force against the inserted mating contact portion.

Figure 5:
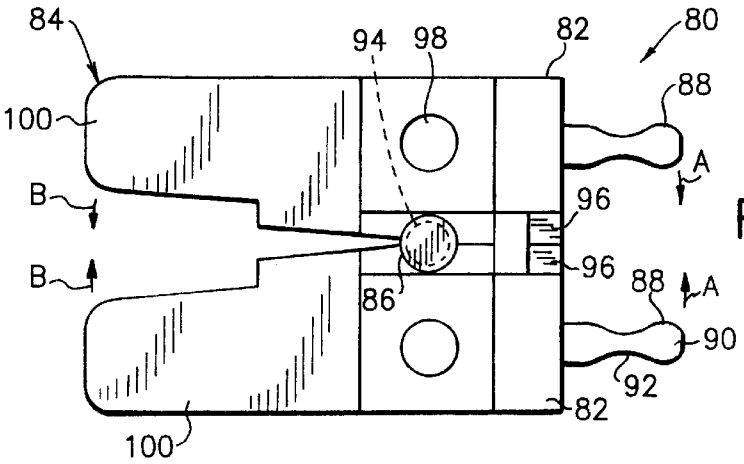
FIG. 5 is a side elevational view of an electrical connector positioning device used to connect the assembly shown in FIG. 1.

Referring also to FIG. 5, a side elevational view of an electrical connector positioning device 80 used to position the two connectors 14 onto the printed circuit board 12 is shown. The device 80 generally comprises electrical connector holders 82 and a control 84 for moving the holders 82. The holders 82 are pivotably connected to each other at a pivot location 86. Each holder 82 has a projection 88 which are each adapted to individually hold a separate one of the connectors 14. The projections 88 each have a front head 90 and a reduced thickness neck section 92. In this embodiment the holders 82 are biased towards a clamping position towards each other, as indicate by arrows A, by a spring 94. However, a spring might not be provided or, any suitable biasing system could be provided. Alternatively, the device might not have a biasing system, such as when the holders 82 are only manually moved. The holders 82 also comprise stop limiters 96.

The stop limiters 96 directly contact each other to limit rotational movement of the projections 88 towards each other. The device 80 also comprises a detent mechanism 98 for locking the holders 82 in the clamping position. However, the detent mechanism might not be provided or any suitable position locking system could be provided. The control 84 generally comprises the spring 94 and finger contact sections 100. The finger contact sections 100 extend from the rear ends of the holders 82. The finger contact sections 100 are adapted to be moved by a user towards each other, as indicated by arrows B. The user can, thus, overcome the biasing force of the spring 94 to pivot the holders 82 relative to each other at the pivot location 86 and move the projections 88 outward relative to each other in opposite directions from directions A.

Figure 6:
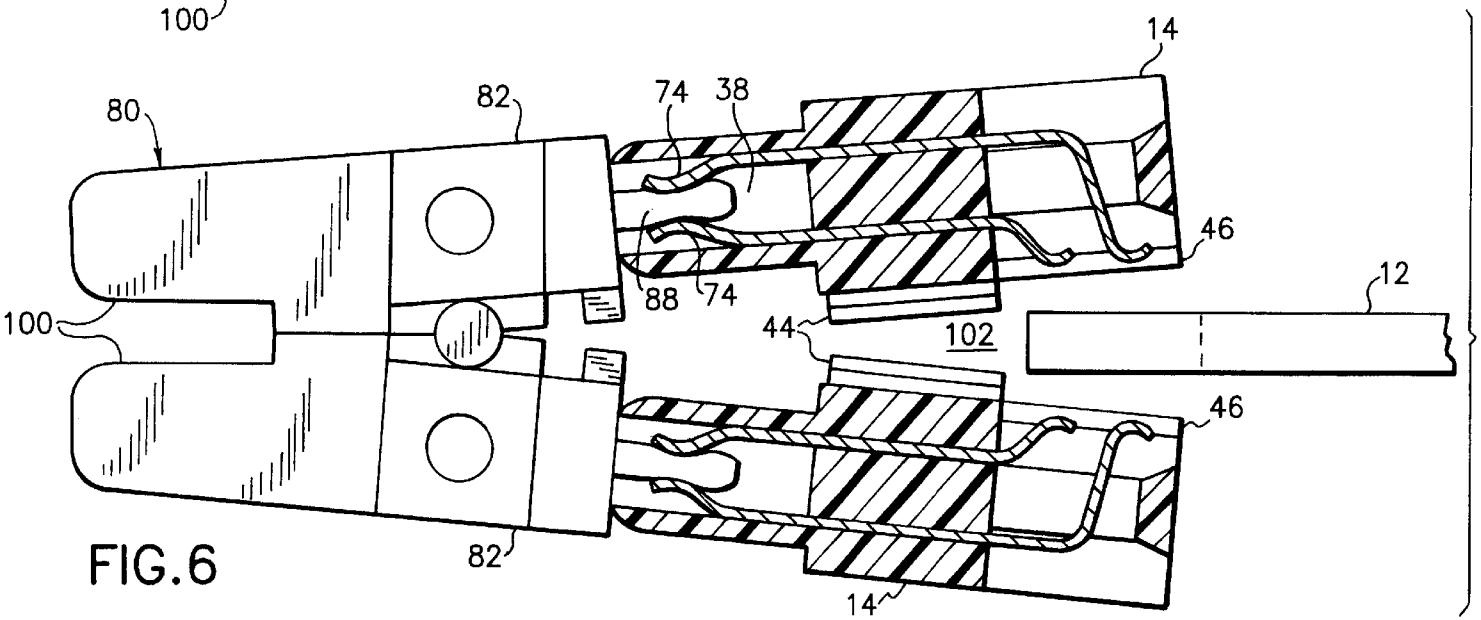
FIG. 6 is an orthographic view of two of the connectors of FIG. 2, attached to the device shown in FIG. 5, and being located over a printed circuit board.

Referring also to FIG. 6, the device 80 is shown with two of the connectors 14 attached to the holders 82 and the device in an open position for mounting the connectors onto the printed circuit board 12. The projections 88 are sized and shaped to be inserted into the receiving areas 38 of the connectors 14 and make a removable mechanical retainment between the rows of spring contact sections 74. The spring contact sections 74 clamp the projections 88 therebetween. The shape of the head 90 and neck 92 also cooperate with the shape of the spring contact sections 74 to retain the connectors 14 on the projections 88. Additional or alternative means could be provided to connect the connectors to the electrical connector positioning device.

Figure 7:
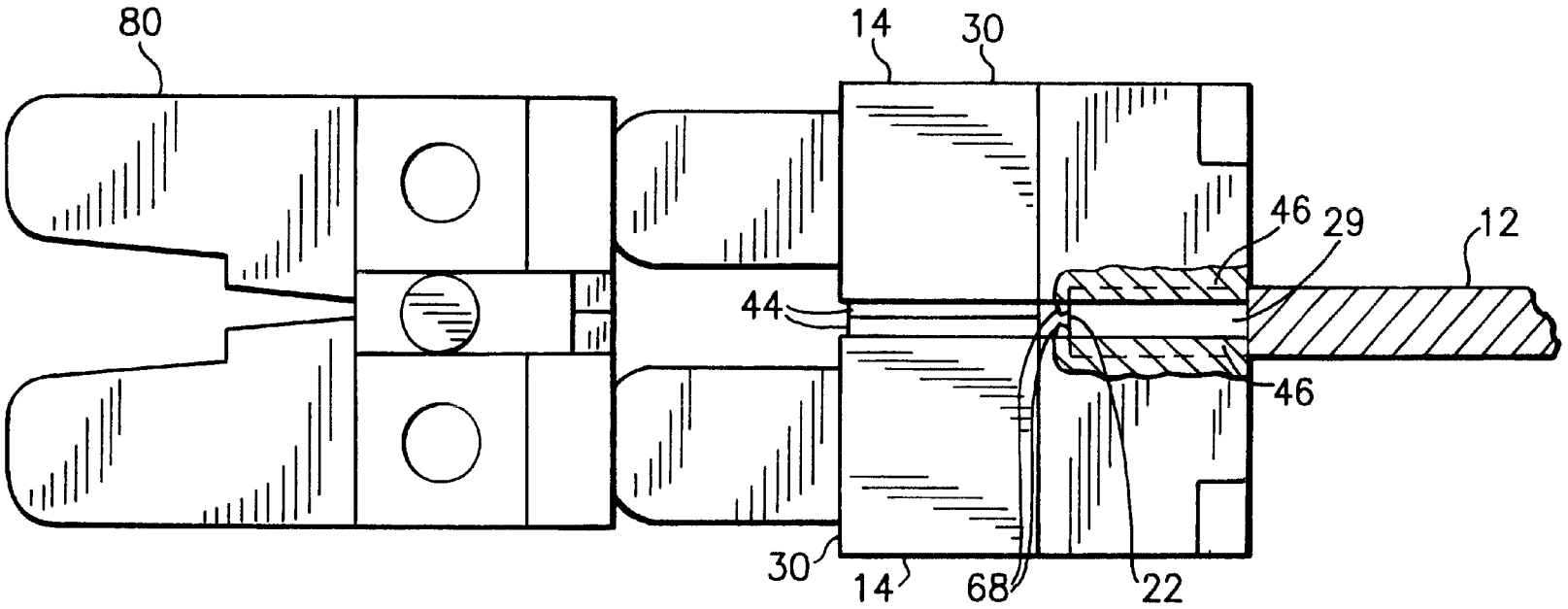
FIG. 7 is an elevational view with a cut away section of the components shown in FIG. 6 with the connectors clamping onto the printed circuit board.

Once the connectors 14 are attached to the device 80, the device 80 is then used to locate the connectors 14 on the board 12 and onto each other. Once the connectors 14 are attached to the device 80, the user pinches the finger contact sections 100 towards each other to move the connectors 14 apart as shown in FIG. 6. This opens an electronic component receiving gap 102 between the two connectors 14. The board 12 is then inserted into the gap 102. The user can then release the finger contact sections 100 and, as shown in FIG. 7, the spring moves the holders 82 to move the connectors 14, close the gap 102, and clamp or sandwich the board 12 between the rear ends of the opposite connectors 14. The lateral end wall portions 56 of the housings 30 extend into the slots 28, 29 to laterally position the connectors 14 on the board 12. The front positioning projections 68 contact the end edge 22 of the board 12 to position the connectors 14 relative to the edge 22. The bottom sections 44 of the housings 30 contact and interlock or intermesh with each other. This helps to position the housings 30 relative to each other. The assembly 12, 14, 14, 80 can now undergo a reflow soldering process to permanently attach the contacts 32 and the hold down 34 to the board 12. Once this is completed, the device 80 can merely be unplugged from the connectors to leave the assembly 10 as shown in FIG. 1.

This invention is in regard to an economical fixturing device that combines two independent multiposition connectors 14 into one unit for the purpose of applying them to a printed circuit board (PCB). The result on the PCB assembly is two surface mounted connectors, on opposite sides of the PCB. Such surface mount leads are shorter and more uniform is length, thus, providing improved connector electrical performance over similar type connectors. The fixturing device makes it easy to install the connectors by securely holding them so that they can be handled by hand, by providing a pivot axis so that they can fit over the surfaces of the PCB without disturbance of the applied solder paste, by providing location alignment with the PCB, by providing a clamping devise to securely hold the connectors in place during soldering, and, the fixture assures that the final relative positions of the two connector is correct for a double stack application.

The purpose of the hold down is to secure the connector to the PCB via soldering. This hold down gives mechanical support to the connector. These hold downs are different from the old hold downs in that they are turned up-side-down, since the connector mounts onto the PCB, 180 degrees from normal. This is due to mating plug connector requirements. The hold downs do not require slots in the PCB. The desire for the slots has to do with the existence of existing walls on the connectors main plastic housing. An existing mold for the outer housing could be modified to decrease the walls size, and eliminate the need for the slots 28, 29. However, these walls and slots provide for some "rough" positional alignment of the connector to the PCB, and are, therefore, beneficial.

In an alternate embodiment, rather than having projections 68, part of the housing 30 could contact the end edge 22 to function as a stop/positioner. The added plastic to the housing would be primarily there to act as guide to locate the connector with respect to the edge of the PCB The added plastic is a "stop". The connector moves over the edge of the PCB during installation, until the connector stops against the edge of the PCB, by the presence of this plastic. Otherwise, the front-to-back connector registration would require additional equipment or operator skill.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a housing having a first section and a second section, the first section being adapted to contact a first side of an electronic component and be fixed thereto, the second section comprising a positioning locator standoff adapted to be located in front of a second side of the electronic component for contacting a cooperating electrically non-mating electrical connector seated against the second side of the electronic component when the housing is located against the first side of the electronic component; and at least one electrical contact connected to the housing having a first end adapted to be attached to the electronic component.

2. An electrical connector as in claim 1 wherein the housing comprises a molded member having the positioning locator standoff integrally formed therewith.

3. An electrical connector as in claim 2 wherein the molded member comprises a contact receiving area having the electrical contact therein.

4. An electrical connector as in claim 1 wherein the first section comprises an electronic component contact surface which is substantially parallel to a cooperating electrical connector contact surface of the positioning locator standoff.

5. An electrical connector as in claim 1 wherein the positioning locator standoff comprises an interlock section for interlocking with a portion of the cooperating electrical connector.

6. An electrical connector as in claim 1 wherein the first section comprises a projection which is adapted to extend into a slot of the electronic component.

7. An electrical connector as in claim 1 wherein the first end of the electrical contact comprises a surface mount solder tail.

8. An electrical connector as in claim 1 wherein the housing comprises a housing member and at least one hold down connected to the housing member, wherein the hold down comprises a first section and a second section angled relative to the first section, the first section being stationarily fixed to the housing member and the second section comprising a substantially planar flat bottom surface adapted to be soldered to a mounting surface on the first side of the electronic component and a front positioning projection extending past the planar flat bottom surface adapted to contact a positioning surface at the second side of the electronic component which is angled relative to the mounting surface.

9. An electrical component assembly comprising:

an electronic component;

two of the electrical connectors as recited in claim 1 connected to opposite sides of the electronic component, wherein the positioning locator standoffs of the two connectors contact each other.

10. An electrical connector comprising:

at least one electrical contact;

a housing member having the at least one electrical contact connected thereto; and at least one hold down connected to the housing member, the hold down comprising a first section and a second section angled relative to the first section, the first section being stationarily fixed to the housing member, and the second section comprising a substantially planar flat bottom surface and a front positioning projection extending past the planar flat bottom surface, wherein the substantially planar flat bottom surface is adapted to be soldered to a mounting surface of an electronic component, and wherein the front positioning projection is adapted to contact an end edge of the electronic component.

11. An electrical component assembly comprising:

an electronic component;

a first electrical connector fixedly mounted on a first side of the electronic component; and a second electrical connector fixedly mounted on an opposite second side of the electronic component, wherein portions of first and second housings of the respective first and second electrical connectors extend past an end edge of the electronic component and contact each other.

12. An assembly as in claim 11 wherein the first electrical connector comprises:

the first housing of the first electrical connector having a first section and a second section, the first section being adapted to contact the first side of an electronic component and be fixed thereto, the second section comprising the portion as a positioning locator standoff adapted to be located in front of a second side of the electronic component for contacting the second electrical connector at the second side of the electronic component when the first housing is located against the first side of the electronic component; and at least one electrical contact connected to the first housing having a first end adapted to be attached to the electronic component.

13. An assembly as in claim 12 wherein the first housing comprises a molded member having the positioning locator standoff integrally formed therewith.

14. An assembly as in claim 13 wherein the molded member comprises a contact receiving area having the electrical contact therein.

15. An assembly as in claim 12 wherein the first section comprises an electronic component contact surface which is substantially parallel to a cooperating electrical connector contact surface of the positioning locator standoff.

16. An assembly as in claim 12 wherein the positioning locator standoff comprises an interlock section for interlocking with a portion of the second electrical connector.

17. An assembly as in claim 12 wherein first section comprises a projection which is adapted to extend into a slot of the electronic component.

18. An assembly as in claim 12 wherein the first end of the electrical contact comprises a surface mount solder tail.

19. An assembly as in claim 12 wherein the first housing of the first electrical connector further comprises at least one hold down connected to the first housing, wherein the hold down comprises a first section and a second section angled relative to the first section, the first section of the hold down being stationarily fixed to the first housing and the second section of the hold down comprising a substantially planar flat bottom surface adapted to be soldered to a mounting surface on the first side of the electronic component and a front positioning projection extending past the planar flat bottom surface adapted to contact the second side of the electronic component.

* * * * *